US006062486A

United States Patent [19]

Hill

[11] Patent Number: 6,062,486

[45] Date of Patent: May 16, 2000

[54] HIGH VOLUME AND LOW PRESSURE WATER CLEANING SYSTEM

[76] Inventor: Frank Hill, 609B 112th St., Arlington, Tex. 76011

[21] Appl. No.: 09/119,159

[22] Filed: Jul. 20, 1998

[51] Int. Cl.[7] ..... B05B 17/00; B05B 3/18

[52] U.S. Cl. ..... 239/1; 239/332; 239/722

[58] Field of Search ..... 239/329, 330, 239/331, 332, 333, 146, 722, 1; 134/198

[56] References Cited

U.S. PATENT DOCUMENTS

| | | | |
|---|---|---|---|
| 4,333,609 | 6/1982 | Backo | 239/146 X |
| 4,817,653 | 4/1989 | Krajicek et al. | 239/722 X |
| 4,848,659 | 7/1989 | Tadych | 239/146 X |
| 4,967,960 | 11/1990 | Futrell | 239/332 X |
| 5,421,520 | 6/1995 | Simonette et al. | 239/332 X |
| 5,816,499 | 10/1998 | Christiansen | 239/146 X |

*Primary Examiner*—Patrick Brinson
*Assistant Examiner*—Sean P. O'Hanlon
*Attorney, Agent, or Firm*—Arthur F Zobal

[57] ABSTRACT

The cleaning system includes a portable water tank, pump, and nozzle member for cleaning air conditioning coils with water at a high volume and low pressure. In the preferred embodiment the system is to be operated to spray water within a range of about 15 to 46 gallons per minute at a pressure of about 350 to 850 psi.

10 Claims, 2 Drawing Sheets

HIGH VOLUME AND LOW PRESSURE WATER CLEANING SYSTEM

BACKGROUND OF THE INVENTION

1. Field of the Invention

The invention relates to a cleaning system for cleaning air conditioning coils.

2. Description of the Prior Art

In the prior art, exterior compressor coils of air conditioners have been cleaned with a garden hose or with high pressure water systems. The typical garden hose has a capacity of about 5 gallons per minute at about 60 psi and the high pressure washer systems have a capacity of about 1.5 to 5 gallons per minute at a pressure of about 1,200 to 4,000 psi. These systems take a relatively long time to clean the coils of large industrial compressor units.

SUMMARY OF THE INVENTION

It is an object of the invention to provide a new and useful water cleaning system for cleaning the coils of an air conditioning system much more rapidly than the cleaning systems that have been used in the past.

The cleaning system of the invention comprises a high volume and low pressure water cleaning system which can rapidly clean the compressor coils of an air conditioning system.

It is a further object of the invention to provide a cleaning system comprising a source of water, a pump, and a nozzle means capable of spraying water at a rate greater than about 15 gallons per minute and at a pressure of 350 to 850 psi.

DESCRIPTION OF THE PREFERRED EMBODIMENTS

Figure 1:
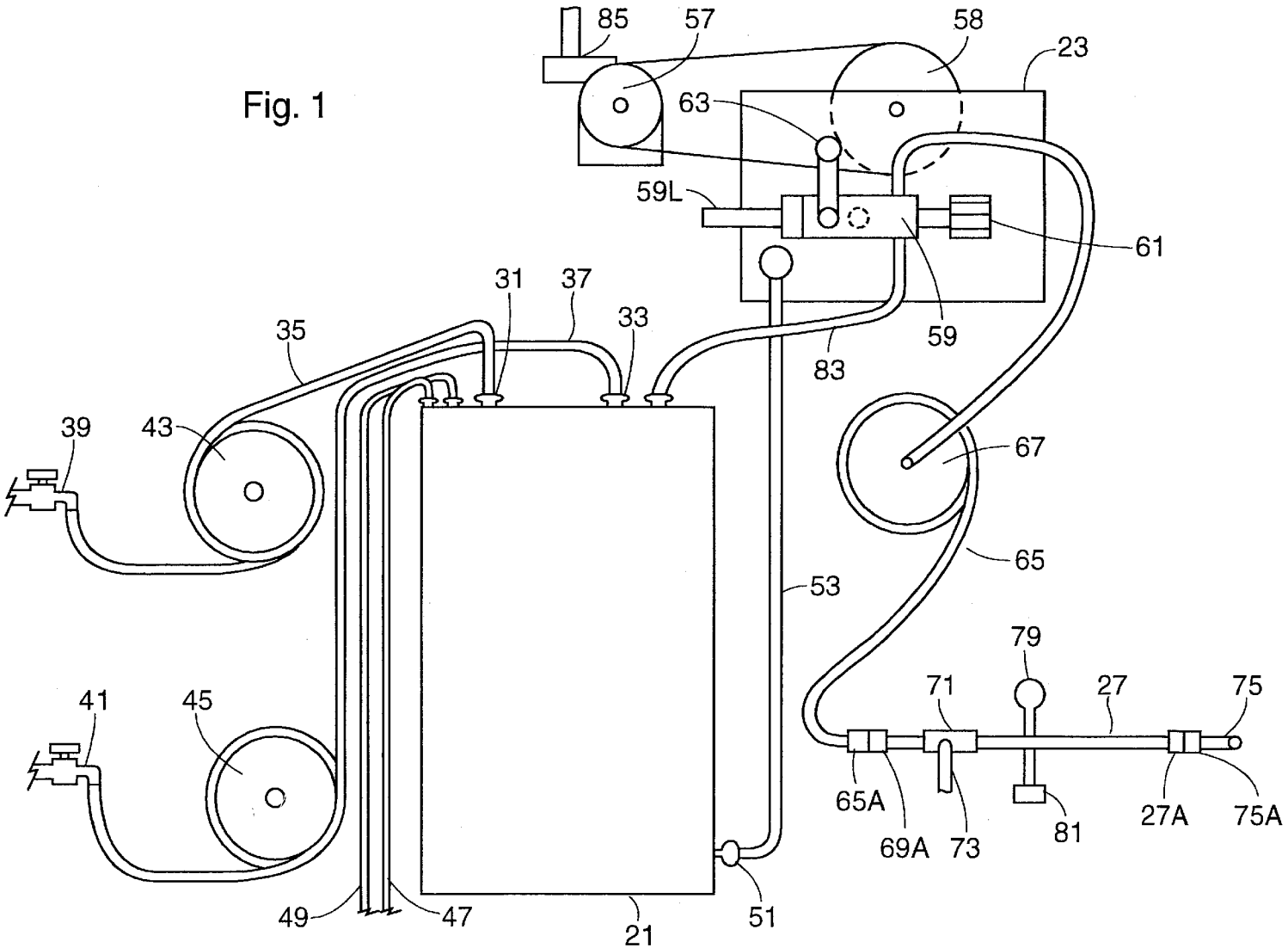
FIG. 1 of the drawings is a schematic illustration of the cleaning system of the invention.
Figure 2:
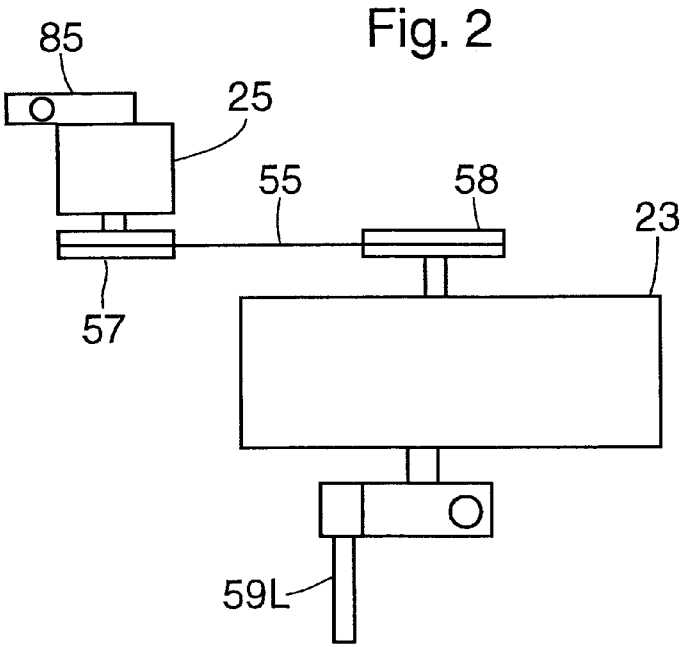
FIG. 2 is a top view of the pump of the system of FIG. 1.
Figure 3:
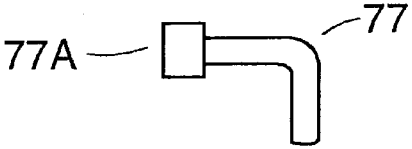
FIG. 3 illustrates a 90 degree spray nozzle.

Referring to the drawing the cleaning system of the invention comprises a portable water tank 21; a portable water pump 23 operated by a gasoline driven motor or engine 25 and a tubular nozzle member 27 all of which can be transported by a small truck such as a pickup truck. The tank 21 has two inlets 31 and 33 for receiving water from hoses 35 and 37 which can be coupled to faucets 39 and 41 located at the house or building where the compressor coils of the air conditioner to be cleaned are located. The hoses 35 and 37 are elongated hoses which can be wound around hose reels 43 and 45. Two overflow hoses 47 and 49 are coupled to the top of the tank. An outlet 51 is coupled to the lower end of the tank 21. A pump feed hose 53 is coupled from the outlet 51 to the pump 23. The pump 23 is operated by the gasoline driven motor 25 by way of a continuous belt 55 coupled to a pulley 57 of the motor 25 and a pulley 58 of the pump 23.

The pump 23 has an outlet valve 59 with a psi adjustment device 61 for adjusting the psi of the water flowing from the pump 23. Member 63 is a visual psi gauge. An elongated hose 65 on a hose reel 67 is coupled to the outlet valve 59 and to the nozzle member 27 for applying water from the pump 23 to the nozzle member 27. Members 65A and 69A are quick connect-disconnect connectors for connecting and disconnecting the nozzle member 27 to and from the hose

65. The nozzle member 27 comprises a ball valve 71 with a control member 73 for controlling the flow of water through the nozzle member 27. The nozzle member 27 comprises a straight nozzle 75 removably coupled to the front end of the member 27 by way of quick connect disconnect members 75A and 27A connected to members 75 and 27 respectively. A 90 degree nozzle 77 may be removably coupled to the front end of the member 27 by way of quick connect disconnect member 77A. Member 79 is a handle and member 81 is a device for removably holding the nozzle 75 or 77 not being used.

The pump 23 can pump up to 46 gallons of water per minute at a pressure of up to 850 psi. Adjustment of the pump to obtain the desired pressure is carried out by adjusting the device 61. The volume of the water pumped can be changed by changing the pulley 58. The preferred volume ranges from about 15 to 46 gallons per minute at a pressure range of about 350 to 850 psi. These ranges have been found to be very effective for rapidly cleaning compressor coils of large air conditioning systems in 15 to 30 minutes. It has been found that the best results have been obtained at a rate of about 25 gallons of water per minute. The pressure used in most cases is about 600 psi. The use of chemicals for cleaning generally is not necessary.

The system of the invention can be used to clean indoor as well as outdoor air conditioning coils.

The pump 23 is available commercially. Member 59L is a lever which can close the valve 59 or open the valve. At start up, the lever 59L may be positioned to initially close the valve and then it is moved to its open position.

If the water to the tubular member 27 is shut off by closure of the member 73, the valve 59 will divert the water being pumped back to the tank 21 by way of a by pass hose 83. The valve 59 is available commercially.

Member 85 is a muffler coupled to the gasoline engine 25.

What is claimed is:

1. A cleaning system, comprising:

a source of water, a pump having an inlet and an outlet, a first conduit coupled from said source of water to said inlet of said pump, a nozzle means, and a second conduit coupled from said outlet of said pump and to said nozzle means for spraying water onto an object to be cleaned, said pump being characterized such that it can pump water from said source of water to said nozzle means at a pressure of about 350 to 850 psi at a rate greater than 15 gallons per minute.

2. The cleaning system of claim 1, wherein said pump is capable of pumping water from said source of water to said nozzle means at a rate of about 15 to 46 gallons per minute.

3. The cleaning system of claim 1, wherein said pump is a diaphragm pump.

4. The cleaning system of claim 1, wherein:

said source of water comprises a portable container and said pump is operated by a gasoline engine.

5. The cleaning system of claim 1, comprising:

a ball valve coupled to said nozzle means for controlling the flow of water to said nozzle means.

6. A cleaning system for cleaning the coils of cooling equipment, comprising:

a portable water tank having an inlet and an outlet, a portable pump having an inlet and an outlet, a flexible conduit to be coupled from a source of water to said inlet of said water tank for applying water into said water tank, a conduit coupled from said outlet of said water tank to said inlet of said pump for applying water to said pump, a nozzle means, a flexible conduit coupled from said outlet of said pump to said nozzle means for spraying water onto the coils of cooling equipment for cleaning purposes, said pump being characterized such that it can pump water from said water tank to said nozzle means at a pressure within a range of about 350 to 850 psi at a rate greater than about 15 gallons per minute.

7. The system of claim 6, wherein:

during cleaning operations said pump is operated to pump water from said water tank to said nozzle means at a pressure of about 350 to 850 psi to pump at a rate greater than about 15 gallons per minute.

8. The system of claim 7, wherein:

during cleaning operations, said pump is operated to pump water at a rate within a range of about 15 to 46 gallons per minute.

9. A method of cleaning the coils of cooling equipment employing a system comprising a portable water tank having an inlet and an outlet; a portable pump having an inlet and an outlet; a flexible conduit coupled from a source of water to said inlet of said water tank for applying water into said water tank; a conduit coupled from said outlet of said water tank to said inlet of said pump; a nozzle means; a flexible conduit coupled from said outlet of said pump to said nozzle means for spraying water onto the coils of cooling equipment for cleaning purposes; said pump being characterized such that it can pump water from said water tank to said nozzle means at a pressure within a range of about 350 to 850 psi at a rate greater than about 15 gallons per minute, comprising the steps of:

operating said pump to pump water from said water tank to said nozzle means at a pressure within the range of about 350 to 850 psi at a rate greater than 15 gallons per minute, and locating said nozzle means at positions to spray water from said nozzle means onto the coils of cooling equipment for cleaning purposes.

10. The method of claim 9, wherein:

said pump is operated to pump water at a rate within a range of about 15 to 46 gallons per minute.

* * * * *